United States Patent [19]

Jacobsen et al.

[11] 4,061,092

[45] Dec. 6, 1977

[54] SUSPENDED SHELF BRACKET

[75] Inventors: Arnold Ralph Jacobsen, Arlington Heights; I. Pompe Jaffe, Skokie, both of Ill.

[73] Assignee: Skyhook Sales Corporation, Niles, Ill.

[21] Appl. No.: 709,808

[22] Filed: July 29, 1976

[51] Int. Cl.[2] ..... C08B 1/00

[52] U.S. Cl. ..... 108/149; 248/300; 248/317; 248/248; 182/198

[58] Field of Search ..... 108/111, 149; 248/317, 248/300, 235, 247, 248, 323; 182/196, 197, 198, 199

[56] References Cited

U.S. PATENT DOCUMENTS

| | | | |
|---|---|---|---|
| 406,257 | 7/1889 | Butler | 182/198 |
| 755,555 | 3/1904 | Weaver | 248/300 X |
| 1,284,235 | 11/1918 | Carlin | 248/317 |
| 1,962,890 | 6/1934 | Berg et al. | 182/196 |
| 2,556,105 | 6/1951 | Rhett | 108/149 X |
| 2,558,323 | 6/1951 | Strun | 108/149 |
| 3,459,396 | 8/1969 | Buttriss | 248/248 X |

FOREIGN PATENT DOCUMENTS

| | | | |
|---|---|---|---|
| 696 of | 1889 | United Kingdom | 248/248 |

*Primary Examiner*—Roy D. Frazier
*Assistant Examiner*—Peter A. Aschenbrenner
*Attorney, Agent, or Firm*—Dominik, Knechtel, Godula & Demeur

[57] ABSTRACT

There is disclosed a novel bracket adapted to support and suspend a shelf platform to further permit the suspension of a plurality of shelf platforms for the use of a plurality of shelf brackets, each bracket formed by a support member including an upwardly extending rib portion and a downwardly extending flange portion, the rib portion having a width dimension less than ½ of the width dimension of the lower extending flange portion and being carried at the approximate mid-position of the lower flange portion, each of the rib and flange portions respectively provided with apertures formed therein adjacent the outer ends, the bracket being completed by support means mounted on the support member intermediate the rib and flange portions respectively and extending laterally outwardly therefrom in normal relation with respect to the plane formed by the rib and flange portions, the support means providing support for a shelf platform to be rested thereupon. A plurality of four shelf brackets is employed to suspend a single shelf platform, and the apertures may then be employed to accommodate a suspension cable such that other shelf brackets may be attached to suspend other shelf platforms thereon thereby forming a series of shelf platforms in vertical orientation one above the other.

4 Claims, 6 Drawing Figures

FIG. 1
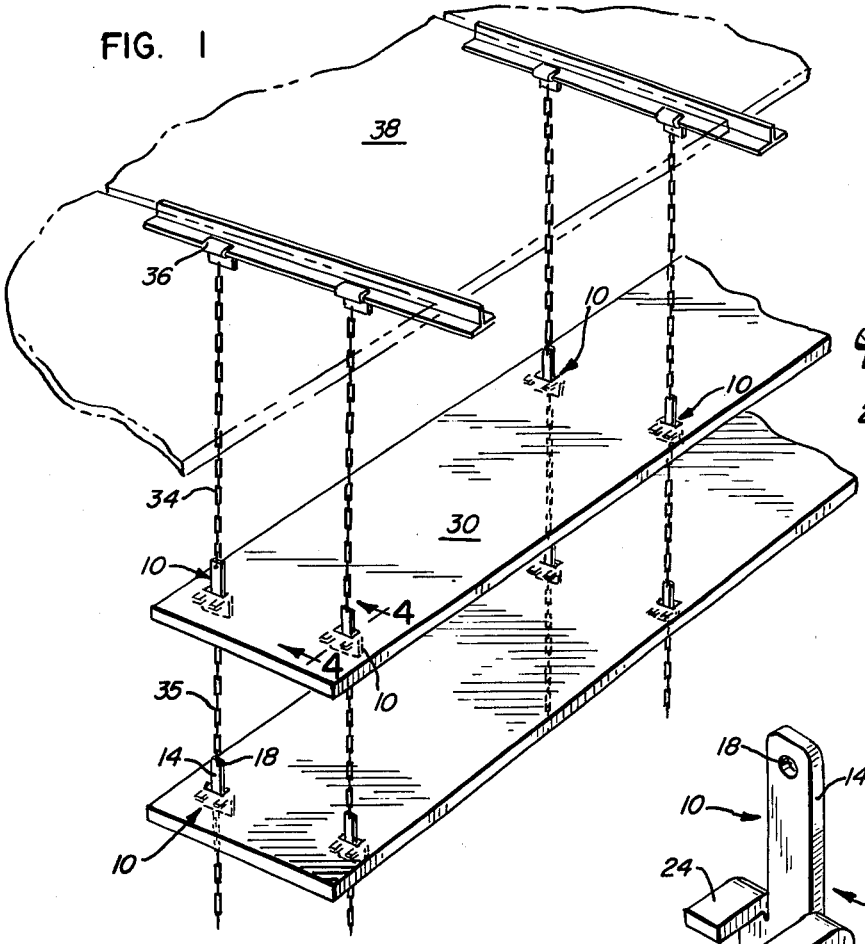
FIG. 4
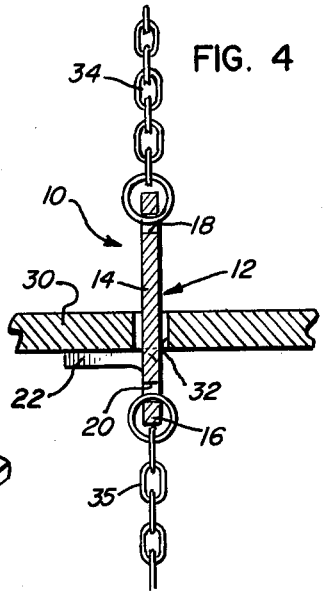
FIG. 5
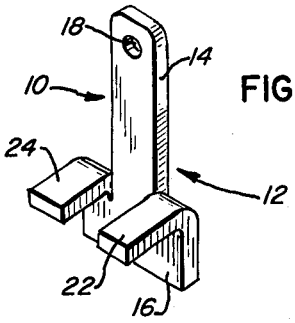
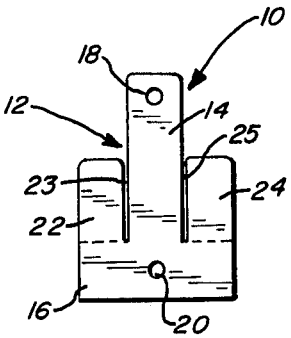
FIG. 2
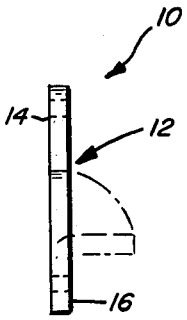
FIG. 3
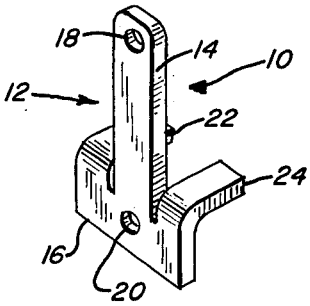
FIG. 6

SUSPENDED SHELF BRACKET

BACKGROUND OF THE INVENTION

It has become aesthically popular to provide various novel means of suspending articles and structures from overhead ceilings or other overhead support means especially in connection with providing a modern decor for living or office premises. In this connection, the development of hook and suspension cable assemblies for suspending plants and other fixtures has become quite popular. And the same applies to the suspension of lamp fixtures and other similar fixtures from ceilings or other overhead fixtures as a means to provide an aesthically pleasing decor in the home furnishing field.

Various arrangements have been attempted for the purpose of permitting the suspension of a plurality of shelf platforms from an overhead structure, but in most of such assemblies, the hardware required to suspend a plurality of shelves positioned in vertical orientation one with respect to the other have been cumbersome and/or expensive. Presently, the only convenient means for organizing a plurality of shelves in vertical orientation has been to mount the same to a wall or other support means such that the shelves are fixedly secured to the wall or support beam structure. The purpose of the present invention is to provide a novel form of shelf bracket which permits a plurality of shelf platforms to be carried between a plurality of four of the above-noted shelf brackets and further permitting a plurality of shelf platforms to be suspended in vertical orientation one with respect to the other, with the entire assembly being suspended from an overhead structure such as a ceiling or support beam. It was further deemed desirable to provide a shelf bracket which would accomplish the suspension of a plurality of shelf brackets, without at the same time requiring that the bracket be fixedly secured to the shelf platform thereby to eliminate the requirement for screws, rivets, or other mounting structures exclusive of the bracket.

OBJECTS AND ADVANTAGES

It is therefore deemed to be a principal object of the invention to provide a novel shelf bracket for supporting a shelf platform formed by a support member including an upwardly extending rib portion forming one end of the support member and a lower extending flange portion formed in the lower portion of the support member, the rib portion having a width dimension less than one-half of the width dimension of the lower extending flange portion being positionally carried at the approximate mid-position of the lower flange portion, each of the rib and flange portions respectively provided with apertures formed therein adjacent the outer ends, the bracket being completed by support means mounted on the support member intermediate the rib and flange portions respectively and extending laterally upwardly therefrom in normal relation thereto to provide a support platform for carrying a shelf platform thereon.

In connection with the foregoing object, it is a further object of the invention to provide a shelf bracket of the type noted wherein a series of four of such brackets may be employed to suspend a single shelf platform, and wherein further, a plurality of shelf platforms may be suspended one atop the other in vertical orientation by the use of a suspension cable secured to the apertures formed in the rib and flange portions of each of the shelf brackets respectively.

Still a further object of the invention is to provide a shelf bracket of the type described wherein the support means comprises a pair of support fingers extending laterally outwardly and in normal relation with respect to the rib and flange portions respectively such that the support fingers form a support surface for carrying a shelf platform thereon and supporting the same.

Yet a further object of the invention is to provide a shelf bracket of the type described wherein the rib portion has a length dimension more than twice the length dimension of the flange portion, and adapted for insertion through an aperture formed in the shelf platform such that the rib portion extends upwardly beyond the upper surface of the shelf platform while the flange portion extends downwardly below the lower surface of the flange portion with the finger support members supporting and carrying the shelf platform thereon.

In connection with the foregoing object, it is yet a further object of the invention to provide a plurality of four of the above-noted shelf brackets for suspending a single shelf platform and wherein a suspension cable may be utilized for interconnecting between the rib portion of one shelf bracket to the flange portion of the next spaced shelf bracket whereby a plurality of shelf platforms may be positioned in vertical orientation and suspended from an overhead support structure such as a ceiling or the like.

Further features of the invention pertain to the particular arrangement of the elements and parts whereby the above-outlined objects and advantages may be obtained. The invention both as to its organization and mode of operation will best be understood by reference to the following specification taken in conjunction with the accompanying drawings in which the figures illustrate the invention.

DESCRIPTION OF DRAWINGS

FIG. 1 is a perspective view showing a series of two shelf platforms each supported by a plurality of four shelf brackets and wherein the entire structure is suspended from an overhead ceiling structure;

FIG. 2 is a front elevational view showing the subject shelf bracket in its pre-formed orientation;

FIG. 3 is a side elevational view showing the relationship between the various portions of the subject shelf bracket in finished form;

FIG. 4 is a side elevational view, in cross section, showing the mode of operation of the subject shelf bracket when inserted and used in conjunction with a shelf platform;

FIG. 5 is a perspective view of the preferred embodiment of the shelf bracket of the present invention; and FIG. 6 is a perspective view showing the preferred side of the subject shelf bracket and taken in a direction opposed from the direction as shown in FIG. 5 of the drawings.

DETAILED DESCRIPTION OF INVENTION

The details of construction of the shelf bracket, generally referred to by the numeral 10, is best illustrated in FIGS. 2, 3, 5 and 6 of the drawings. It will be observed that the shelf bracket 10 is formed by a support member 12 which includes an upwardly extending rib portion 14 and a lower extending flange portion 16.

The upper rib portion 14 includes a suspension aperture 18 while similarly, the lower flange portion 16 includes a suspension aperture 20.

The shelf bracket 10 is shown to be completed by a pair of support fingers 22 and 24 respectively which are positioned intermediate the rib portion 14 and flange portion 16, and extend laterally outwardly and in normal relation with respect to the rib and flange portions 14 and 16, respectively. As shown in FIGS. 2 through 6 of the drawings, the support fingers 22 and 24 are actually formed as an integral portion of the shelf bracket 10, and as viewed in FIGS. 2 and 3 of the drawings, the support fingers 22 and 24 are actually part of the stamping forming the shelf bracket 10. In the preferred embodiment, the fingers 22 and 24 are actually upstanding from the flange portion 16 with slots 23 and 25 separating the fingers 22 and 24 from the rib portion 14.

As indicated, the shelf bracket 10 is preferably formed as a stamping such that the suspension apertures 18 and 20 as well as the rib portion 14, flange portion 16, and finger members 22 and 24 are stamped as a single operation. The shelf bracket 10 is completed by bending the support fingers 22 and 24 throughout an angle of 90° whereby the support fingers 22 and 24 are positioned in normal relation with respect to the rib and flange portions 14 and 16, respectively.

Further, as indicated in the drawings, it is contemplated that the rib portion 14 will have a length at least or greater than twice the length of the flange portion 16 in order to accommodate the mode of insertion contemplated by the present assembly. As shown in FIG. 4 of the drawings, the shelf platform 30 is provided with a hanging aperture 32 and accommodates the insertion therethrough of the rib portion 14. The lower surface of the shelf platform 30 rests against the upper surface of the support fingers 22 and 24 thereby to eliminate the necessity for any fastening fixtures such as screws, rivets, nails, or the like. As shown in FIG. 1 of the drawings, a series or plurality of four shelf brackets 10 may be employed to suspend a single shelf therefrom in the manner indicated above. The shelf platform 30 would therefore be provided with four hanging apertures 32 to accommodate the insertion therethrough of each of the rib portions 14 of the shelf bracket 10. As shown in FIG. 4 of the drawings, the suspension aperture 18 of the rib portion 14 will extend above the top surface of the shelf platform 30 and accommodate the insertion therein of a suspension cable in the form of a suspension chain 34. The suspension chain 34 extends upwardly to a mounting clamp 36 (FIG. 1) which in turn connects to an overhead ceiling, 38, or the supports which support the overhead ceiling.

Further, as shown in FIG. 4 of the drawings, due to the construction of the shelf bracket 10, the suspension aperture 20 in the flange portion 16 extends below the lower surface of the shelf platform 30 and similarly accommodates the insertion of a suspension chain 35 extending downwardly therefrom. Again, as shown in FIG. 1 of the drawings, the lower suspension chain 35 may interconnect with the suspension aperture 18 in the rib portion 14 of the next lower shelf bracket 10, and by providing a shelf platform having a series of four shelf brackets 10 in vertical alignment with the shelf brackets 10 of the first shelf, a plurality of shelf platforms 30 may be suspended in vertical orientation. In addition, it will be observed that none of the shelf brackets 10 require the provision of any fastening fixtures such as screws, nails, rivets, or the like, but are simply installed by inserting the same through hanging apertures provided in the shelf platform.

It will therefore be appreciated that the advantage offered by the shelf bracket formed in accordance with the present invention is to permit a plurality of shelves to be suspended from an overhead supporting structure such as a ceiling, beam, or the like, thereby eliminate the necessity of mounting shelves to a wall or other side support structure. In this manner, an aesthically pleasing decor may be established without the necessity of complicated hardware or difficult installation.

It will also be appreciated that the shelf bracket of the present invention may be formed by a stamping operation as indicated previously, thereby to minimize the cost of manufacture. As shown in FIGS. 2 and 3 of the drawings, the shelf bracket 10 may simply be stamped from a sheet of the material to be utilized, preferably a metallic material such as steel, and the assembly completed by simply bending the support fingers 22 and 24 through an arc of 90° to position the same in normal relation with respect to the rib and flange portions 14 and 16, respectively. Hence, the cost of manufacture is minimal and therefore, the ultimate cost of the subject shelf bracket is similarly kept at a minimal level. This enhances the commercial aspect of the device since it is ideally suited for the "do-it-yourself" market and permits the consumer to easily install a shelf by merely tapping four holes into the shelf to be mounted, inserting the rib portion 14 of the shelf bracket 10 therethrough, and applying the suspension chain 34 thereto. It will therefore be appreciated by virtue of the above description and accompanying drawings that a novel but relatively inexpensive shelf bracket has been provided which permits the suspension of a shelf platform without the requirement for any extraneous fastening elements such as nail, screws, rivets or the like to be utilized. Furthermore, the shelf bracket of the present invention permits ease of manufacture at a minimal cost thereby rendering the shelf bracket highly amiable to the mass consumer market. Furthermore, the shelf bracket of the present invention permits ease of installation by the consumer without the need of any special tools or fastening fixtures.

While there has been described what is at present considered to be the preferred embodiment of the invention, it will be understood that various modifications may be made therein and it is intended to cover in the appended claims all such modifications as fall within the true spirit and scope of the invention.

We claim:

1. A bracket adapted for the support and suspension of a plurality of shelf platforms comprising a support member formed by an upwardly extending rib portion forming one end of said support member and a lower extending flange portion forming the lower portion thereof, said upwardly extending rib having a width dimension less than one-half of the width dimension of said lower extending flange portion and being positionally carried at the approximate midposition of said lower flange portion, each of said upwardly extending rib and lower extending flange portions provided with apertures formed therein adjacent the outer ends thereof respectively, said bracket being completed by support means mounted on said support member intermediate said upwardly extending rib portion and said lower extending flange portion, said support means formed by a pair of support fingers extending laterally outwardly and in normal relation with respect to said rib and flange portions respectively, whereby a plurality of said shelf brackets may be employed to freely suspend a shelf platform by inserting said rib portion of said shelf bracket through an aperture provided in the shelf platform until the lower surface of the shelf platform is supported by said support means extending laterally outwardly from the support member, and said upper and lower apertures provided in said rib portion and flange portion respectively accommodating the insertion therein of a suspension cable whereby the cable extending upwardly from said rib portion interconnects with the support structure positioned thereabove while the cable extending from the aperture in said flange portion downwardly supports the next freely suspended shelf platform therebelow.

2. The shelf bracket structure as set forth in claim 1 above, wherein the length dimension of said rib portion is more than twice the length dimension of said flange portion.

3. The shelf bracket as set forth in claim 1 above, wherein said finger members are each formed by an out-turned section of said flange portion such that said out-turned portions extend laterally outwardly and in normal relation with respect to said rib portion and flange portion respectively.

4. The shelf bracket assembly as set forth in claim 1 above, wherein a plurality of four shelf brackets are employed for the suspension of a single shelf bracket.

* * * * *